US008223980B2

(12) United States Patent
Dooling et al.

(10) Patent No.: US 8,223,980 B2
(45) Date of Patent: Jul. 17, 2012

(54) METHOD FOR MODELING EFFECTS OF ANTHROPOGENIC NOISE ON AN ANIMAL'S PERCEPTION OF OTHER SOUNDS

(76) Inventors: Robert J. Dooling, Gaithersburg, MD (US); Marjorie R. Leek, Portland, OR (US); Ed W. West, Davis, CA (US)

( * ) Notice: Subject to any disclaimer, the term of this patent is extended or adjusted under 35 U.S.C. 154(b) by 307 days.

(21) Appl. No.: 12/732,801

(22) Filed: Mar. 26, 2010

(65) Prior Publication Data

US 2010/0246835 A1 Sep. 30, 2010

Related U.S. Application Data

(60) Provisional application No. 61/164,126, filed on Mar. 27, 2009.

(51) Int. Cl.
*H04R 29/00* (2006.01)

(52) U.S. Cl. ..... 381/56

(58) Field of Classification Search ..... 381/56, 381/58, 59, 60, 124; 367/139; 700/94; 704/239, 704/240; 455/63.1, 67.11; 119/713, 718, 119/712, 174

See application file for complete search history.

(56) References Cited

U.S. PATENT DOCUMENTS 6,285,630 B1 * 9/2001 Jan ..... 367/139
7,454,334 B2 * 11/2008 Agranat ..... 704/231
2011/0135102 A1 * 6/2011 Huang et al. ..... 381/58

OTHER PUBLICATIONS

Janik, "Source levels and the estimated active space of bottlenose dolphin (*Tursiops truncates*) whistles in the Moray Firth, Scotland"; May 2000, Springer-Verlag; pp. 673-680.*
Lohr et al; "Detection and discrimination of natural calls in masking noise by birds: estimating the active space of a sign"; Mar. 2002, Animal Behaviour, pp. 763-777.*
J.C. Saunders and R.J. Dooling, "Noise-Induced Threshold Shift in the Parakeet (*Melopsittacus Undulatus*)." Proc. Nat. Acad. Sci. USA. 71, pp. 1962-1965 (Feb. 15, 1974).
R.J. Dooling, "Auditory Perception in Birds." (Chapter 4 in D. Kroodsma and E. Miller eds.). *Acoustic Comminication in Birds*, vol. 1, pp. 95-130. Academic Press, New York (1982).
U. Langemann, B. Gauger, and G.M. Klump. "Auditory Sensitivity in the Great Tit: Perception of Signals in the Presence and Absence and Absence of Noise," Amin. Behav., 56, pp. 763-769 (Mar. 4, 1998).
H. Slabbekoorn and M. Peet, "Birds Sing at a Higher Pitch in Urban Noise," Nature, 424, p. 267 (Jul. 17, 2003.

(Continued)

*Primary Examiner* — Hai Phan
*Assistant Examiner* — David Ton
(74) *Attorney, Agent, or Firm* — Thomas & Karceski, PC

(57) ABSTRACT

The invention is a software program which estimates the effect of environmental noise on hearing and acoustic communication in birds and other animals. The calculation uses information about the acoustic characteristics of the environmental noise, the acoustic characteristics of the vocalization or bioacoustic signal, and information about species specific hearing capabilities to provide a quantitative estimate of the impact on auditory perception. The program will operate in two modes. It will make ball park estimates of noise and signal transmission through a particular type of environment for its calculations of audibility. Or, it will take as input, estimates of the noise and the signal at the bird as generated from existing commercial software and use these estimates in the calculation of audibility.

15 Claims, 14 Drawing Sheets

OTHER PUBLICATIONS

R.J. Dooling, B. Lohr, and M. Dent, "Hearing in Birds and Reptiles," (Chapter 7 in R.J. Dooling, A.N. Popper, and R R. Fay eds.), *Comparative Hearing: Birds and Reptiles*, pp. 308-359, Spriger-Verlag, New York (2000).

B. Lohr, T.F. Wright, and R.J. Dooling. "Detection and Discrimination of Natural Calls in Masking Noise by Birds: Estimating the Active Space of a Signal," Anim. Behav. 65, pp. 763-777 (Jun. 5, 2002).

J.D. Miller, "Effects of Noise on People," J. Acoust. Soc. Am., 56, pp. 729-763 (Apr. 8, 1974).

R.J. Dooling, M.L. Dent, A.M. Lauer, and B.M. Ryals, "Fuctional Recovery After Hair Cell Regeneration in Birds," (Chapter 4 in R.J. Salvi, A.N. Popper, and R.R. Fay eds.), *Hair Cell Regeneration, Repair and Protection*. vol. 33, Springer Handbook of Auditory Research (2008).

H. Brumm, "The Impact of Environmental Noise on Song Amplitude in a Territorial Bird," J. Anim. Ecol., 73, pp. 434-440 (2004).

A.J. Niemec, Y. Raphael, and D.B. Moody, "Return of Auditory Function Following Structural Regeneration After Acoustic Trauma: Behavioral Measures from Quail," Hear. Res., 79, pp. 1-16 (Jan. 12, 1994).

E. Hashino and M Sokabe, "Kanamycin Induced Low-Frequency Hearing Loss in the Budgerigar (*Melopsittacus undulatus*)," J. Acoust. Soc. Am., 85, pp. 289-294 (Sep. 21, 1988).

B.M. Ryals, R.J. Dooling, E. Westbrook, M.L. Dent, A. MacKenzie, and O.N. Larsen, "Avian Species Differences in Susceptability to Noise Exposure," Hearing Research, 131, pp. 71-88 (Jan. 2, 1999).

E. Quintana-Rizzo and D A Mann, Estimated Communication Range of Social Sounds Used by Bottlenose Dolphins (*Tursiops trancatus*), J. Acoust. Soc. Am., 120, pp. 1671-1683 (Sep. 2006).

H. Slabbeboorn and E.A. Ripmeester, "Birdsong and Anthropogenic Noise: Implications and Applications for Conservation," Molecular Ecology, pp. 1-12 (Jul. 4, 2007).

H. Slabbekoorn and W. Halfwerk, "Behavioral Ecology: Noise Annoys at Community Level," Current Biology, vol. 19, No. 16, pp. R693-R695 (Jul. 2009).

R.J. Dooling, "Behavior and Psycophysics of Hearing in Birds," (Chapter 9), The Rockefeller University, Field Research Station, New York, pp. 261-288 (undated).

R.J. Dooling, "Estimating Effects of Highway Noise on the Avian Auditory System," ICOET Proceedings, Chapter 2 (2005).

R.J. Dooling and A.N. Popper, "The Effect of Highway Noise on Birds," Report for the California Department of Transportation, Division of Environmental Analysis, accessible at http://www.dot.ea.gov/bq/env/bio/files/caltrans_birds_10-7-2007b.pdf (Oct. 7, 2007) (74 pages).

* cited by examiner

METHOD FOR MODELING EFFECTS OF ANTHROPOGENIC NOISE ON AN ANIMAL'S PERCEPTION OF OTHER SOUNDS

CROSS-REFERENCE TO RELATED APPLICATION(S)

This is a United States Non-Provisional Patent Application that relies for priority on U.S. Provisional Patent Application Ser. No. 61/164,126, filed on Mar. 27, 2009, the contents of which are incorporated herein by reference.

FIELD OF THE INVENTION

The present invention relates to a method for modeling the effects of anthropogenic noise on an animal's perception of other sounds. More specifically, the present invention provides a method for modeling the effects of anthropogenic noise on birds within a localized environment.

DESCRIPTION OF THE RELATED ART

Highway and other anthropogenic noises can cause a variety of adverse effects on birds and other wildlife.

These effects include stress and physiological changes, auditory system damage from acoustic overexposure, and masking of communication and other important biological sounds.

A precise understanding of these effects is of interest to many groups including biologists, environmentalists, and government regulators, as well as city planners and roadway and construction engineers.

For a number of reasons, it is difficult to reach a clear consensus on the causal relationships between noise levels and the adverse effects of noise on indigenous fauna, in particular birds. One reason for this is that there are surprisingly few studies in birds (or other fauna) that can definitively identify anthropogenic noise alone as the principal source of stress or physiological effects on those organisms. A second reason is that, while all humans, as a species, have similar auditory capabilities and sensitivities, the same is not true for birds and other organisms, because these groups are made up of many different species. Still another issue concerns how to separate the various effects of noise.

There are well documented adverse consequences of elevated noise on humans including hearing loss, masking, stress, physiological and sleep disturbances, and changes in feelings of well-being. It would not be too surprising to find a similar range of effects in birds.

A recent review of the effects of highway noise on birds attempted to provide a framework for conceptualizing the separate and integrated effects of anthropogenic noise on birds. In particular, the study focused on the effects of noise and its effects on masking the communicative utterances from birds. In other words, the study examined how noise interferes with vocal communications between birds.

This study is useful because independent of other effects, masking of communication signals and other important biological sounds (e.g., sounds of an approaching predator) can potentially have significant adverse consequences for species' behavior and population viability. Most vocal species rely on acoustic communication for species and individual recognition, mate selection, territorial defense, parent-offspring communication and detection of predators/prey.

Understanding how and to what extent masking can affect communication between individuals is an important first step toward determining the level of impact to them, and to the species.

While studies such as this are useful, there remains a dearth of procedures or methodologies that permit a reproducible assessment of anthropogenic noise on fauna.

SUMMARY OF THE INVENTION

The present invention overcomes at least some of the problems in the prior art in that it provides a method for modeling the effects of anthropogenic noise on fauna.

Specifically, in one contemplated embodiment, the present invention provides a method for modeling the effects of anthropogenic noise on an animal's perception of sounds such as vocalizations. The method includes positioning an acoustic receiver in an environment and receiving, via the acoustic receiver, a first acoustic input. The first acoustic input includes at least a first magnitude and a first spectral composition. The first acoustic input establishes a first baseline for sound waves existing in the environment. The method also includes generating a first acoustic input signal from the first acoustic input and transmitting the first acoustic input signal to a signal processor. In addition, a second acoustic input signal is received by the signal processor. The second acoustic input signal includes at least a second magnitude and a second spectral composition. The second acoustic input signal establishes a second baseline for sound wave generation by a sender. The method also includes receiving a third input signal by the signal processor. The third input signal comprises at least a quantification of auditory sensitivity in noise (e.g. critical ratio) by a recipient. Then, the method combines, via the signal processor, the first acoustic input signal, the second acoustic input signal, and the third input signal to produce a comparison signal. Finally, based on the comparison signal, the method determines a probability of detection of the second acoustic signal by the recipient.

The present invention also contemplates a method that further includes receiving, via the acoustic receiver, a second acoustic input. The second acoustic input includes at least the second magnitude and the second spectral composition. The second acoustic input establishes the second baseline for sound wave generation by the sender. This aspect of the method includes generating the second acoustic input signal based on the second acoustic input, and transmitting the second acoustic input signal to the signal processor.

In another aspect of the method of the present invention, the method includes determining a first location for the first acoustic input, generating a first location signal, and transmitting the first location signal to the signal processor. This variation of the method further includes determining a second location for the second acoustic input generated by the sender, generating a second location signal, and transmitting the second location signal to the signal processor. The signal processor receives a third location signal representative of the recipient at a third location and calculates a distance between the second location and the third location. In addition, the method includes calculating an attenuation of the second acoustic input taking into account at least the first acoustic input and the distance and generating an attenuation signal from the attenuation. When comparing the first acoustic input signal, the second acoustic input signal, and the third input signal, modeling the interaction of the first acoustic signal and the second acoustic signal with respect to the attenuation signal.

It is contemplated that, for the method of the present invention, the sender is positioned at the second location.

In a variation of the method of the present invention, it is anticipated that the method also includes generating a first location signal representative of a predetermined first distance from the acoustic receiver to the first acoustic input, transmitting the first location signal to the signal processor. In this variation, a second location signal representative of a predetermined second distance from the acoustic receiver to the second acoustic input is generated and transmitted to the signal processor. A third location signal representative of the recipient at a third location is received by the signal processor. Then, the signal processor calculates a distance between the second location and the third location and also calculates an attenuation of the second acoustic input taking into account at least the first acoustic input and the distance. An attenuation signal from the attenuation is then generated. When comparing the first acoustic input signal, the second acoustic input signal, and the third input signal, the interaction of the first acoustic signal and the second acoustic signal is modeled with respect to the attenuation signal.

In one aspect of the present invention, the predetermined first distance from the acoustic receiver to the first acoustic input is at least 1 meter and the predetermined second distance from the acoustic receiver to the second acoustic input is at least 1 meter.

With respect to the present invention, it is contemplated that the first baseline for sound waves in the environment comprises noise existing in the environment.

In one contemplated embodiment of the present invention, the second baseline for sound wave generation by the sender includes a vocalization by the sender.

In the present invention, it is contemplated that the sender and the recipient comprise at least one species from the animal genus.

In another contemplated embodiment, the at least one species encompasses birds.

It is also contemplated by the present invention that the sender and the recipient are different species from the animal genus.

In addition, the first acoustic input may further include ambient environmental sound in addition to noise.

In one aspect of the method of the present invention, when comparing the first acoustic input signal, the second acoustic input signal, and the third input signal, the first acoustic input signal and the second acoustic input signal are compared with the third input signal to determine if one or both of the first acoustic input and the second acoustic input exceed a threshold for auditory detection by the recipient.

Other aspects of the present invention will be made apparent from the discussion that follows.

BRIEF DESCRIPTION OF THE DRAWINGS

The present invention will now be described in connection with one or more drawings, in which.

DESCRIPTION OF EMBODIMENT(S) OF THE INVENTION

Figure 1:
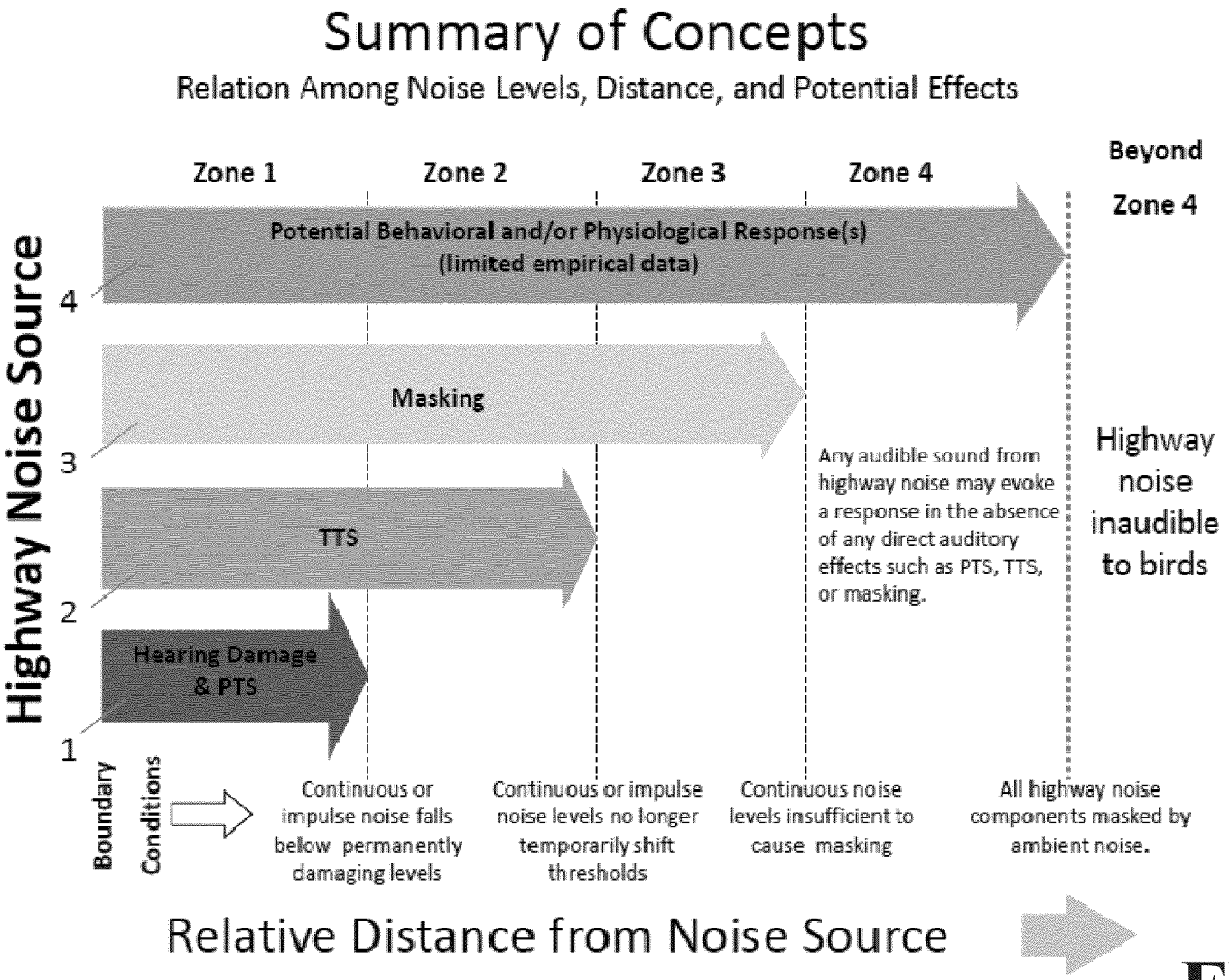
FIG. 1 is a schematic representation of four categories of anthropogenic noise effects that underlie aspects of the present invention.

The invention will now be described in connection with one or more embodiments. It should be appreciated that the invention is not intended to be limited solely to the embodiment(s) described. To the contrary, as should be appreciated by those skilled in the art, there are numerous variations and equivalents to the embodiment(s) that are described herein. The present invention is intended to encompass those variations and equivalents.

As noted above, understanding how and to what extent masking, among other impacts of sound, can affect communication between individual organisms is an important first step toward determining the level of impact on the individuals, on a group of individual animals, or on a species.

The present invention focuses on anthropogenic noise and the impact that this noise has on birds. It is noted that, while birds are discussed herein, the present invention may be applied equally to any organism that creates and/or responds to aural stimuli. As a result, while the instant disclosure focuses on avian organisms, the present invention is intended to encompass non-avian fauna. The present invention may be employed, for example, in an underwater environment.

Before being able to evaluate the effects of noise, it is first necessary to establish parameters that help to classify and categorize the different levels of noise that are typically found in a particular locus.

A conceptual model is helpful here. The conceptual model employed here helps to identify and differentiate four classes of anthropogenic noise effects that may be impingent on birds in a particular location. In addition, the conceptual model also provides spatial relationships with respect to the four classes of anthropogenic noise.

This conceptual model is presented to establish a heuristic baseline for differentiating the four classes of anthropogenic noise effects and to highlight the relative importance of masking. The present invention encompasses this conceptual model as well as a computational model that shows the effects of masking on communication distances between birds exposed to noise, based on their auditory capabilities and the acoustic dynamics of signal transmission in different environments.

In the conceptual model, there are generally four overlapping categories of anthropogenic noise effects on animals, in particular birds. The four effects are listed in order of decreasing magnitude of the noise: (1) hearing damage and permanent threshold shift ("PTS") from acoustic overexposure, (2) temporary threshold shift ("TTS") from acoustic overexposure, (3) masking of important biological sounds, and (4) other physiological and behavioral responses, also referred to as non-auditory noise effects.

Hearing damage and permanent threshold shift (PTS) refers to a level of noise that results in permanent damage to the sound recipient's auditory system. A permanent threshold shift refers to a permanent decrease in the recipient's aural sensitivity as a result of the sound impingent on the recipient's sound receptors. Temporary threshold shift noise refers to a noise level that is less severe than PTS noise. Here, the noise is of a magnitude that the recipient's aural receptors are affected for a temporary time period, but recover after healing. After healing, the recipient's aural receptors return to a baseline sensitivity. The temporary threshold shift, therefore, refers to a temporary decrease in the aural sensitivity of the recipient's aural receptors as a result of the impingent noise. Masking noise refers to a level of noise that does not necessarily result in either a permanent or a temporary threshold shift, but does interfere with the perception of other sounds. Masking noise, however, is of a sufficient magnitude to prevent the recipient from detecting other sounds of interest. In other words, masking noise is of a sufficient magnitude to block or mask important biological sounds such that they cannot be detected by the recipient's aural receptors. At sufficiently low noise levels, non-auditory noise effects may occur in the absence of the other three effects. The noise does not necessarily mask important biological sounds even though this noise may elicit a physiological or behavioral response from the recipient.

In all but the last case, the effects depend strongly on the level of noise exposure, which is highly correlated with the proximity of the bird to the noise source. The relationship between these four categories of noise is represented schematically in FIG. 1.

As shown in FIG. 1, highway noise (which is indicated in the left margin of the figure) is used as an example of an anthropogenic noise source. FIG. 1 is adapted from a recent report on the effects of highway noise on birds and shows the conceptual relationships among different noise levels, the distance of the bird from the noise source, and the different kinds of effects of noise on birds. The different kinds of effects of noise on birds helps to these effects from those of masking alone.

As noted above, masking noise is of particular interest because it does not necessarily result in either permanent or temporary hearing loss. However, because masking can prevent a recipient animal from hearing specific aural inputs, masking noise may have an adverse effect on the individual and, of course, a species of animals. For example, if noise masks the vocalizations of potential mates within a determined location, the birds cannot find one another to reproduce. This can result in a decrease in the population of the birds. Separately, if masking noise prevents birds from hearing potential predators, the birds are more susceptible to predators. This can also result in a decrease in the local avian population. Masking noise also can produce other effects on birds within a particular location, as should be appreciated by those skilled in the art.

The relationship between the four categories of noise effects and the distance from the noise source is illustrated in FIG. 1. These effects are over lapping, as shown by the horizontal bars in FIG. 1. The most damaging type of noise effect is PTS. While PTS noise effects extend the shortest distance from the highway noise source, it is the most damaging because the effect on birds is permanent. The second most damaging noise category is TTS noise effects. This category of noise effects extends a further distance from the highway noise source than the PTS noise. The third category of noise effects is masking noise. Masking noise effects extends a further distance from the highway noise source than TTS noise effects. The fourth category of noise effects is non-auditory noise effects, which may solicit a physiological and/or behavioral response from a bird within the aural range of this noise. Non-auditory noise effects extend the furthest of the four categories of noise.

As also specified in FIG. 1, the four categories of noise are associated with zones from the highway noise source. PTS noise establishes a first zone (or Zone 1) from the highway noise source. TTS noise establishes a second zone (or Zone 2) from the highway noise source. Zone 2 extends a further distance from the highway noise source than Zone 1. Masking noise establishes a third zone (or Zone 3) that extends a distance from the highway noise source. Zone 3 extends a further distance from the highway noise source than Zone 2. Non-auditory noise effects define a fourth zone (or Zone 4), which extends a distance from the highway noise source greater than Zone 3.

FIG. 1 also provides definitions of the boundary conditions from one zone to the next. The boundary between Zone 1 and Zone 2 is characterized by the distance from the highway noise source where continuous or impulse noises fall below a threshold where permanent damage occurs. The boundary between Zone 2 and Zone 3 occurs where continuous or impulse noise levels no longer causes permanent or temporary hearing loss. In other words, this boundary defines the point beyond which the bird's hearing function is no longer impacted by the highway noise source. The boundary between Zone 3 and Zone 4 is defined as the point where continuous noise, for example, in the 2-8 kHz region, no longer causes masking. The boundary of Zone 4 is defined as the point beyond which highway noise is masked by ambient noise. In other words, beyond this boundary, only ambient noise is detected.

As illustrated in FIG. 1, each of the categories of noise is provided with a reference numeral that coincides with the zones discussed above. PTS noise is referred to as "1." TTS noise is given the reference numeral "2." Masking noise is designated by the numeral "3." Finally, non-auditory noise effects is designated with the number "4."

Figure 2:
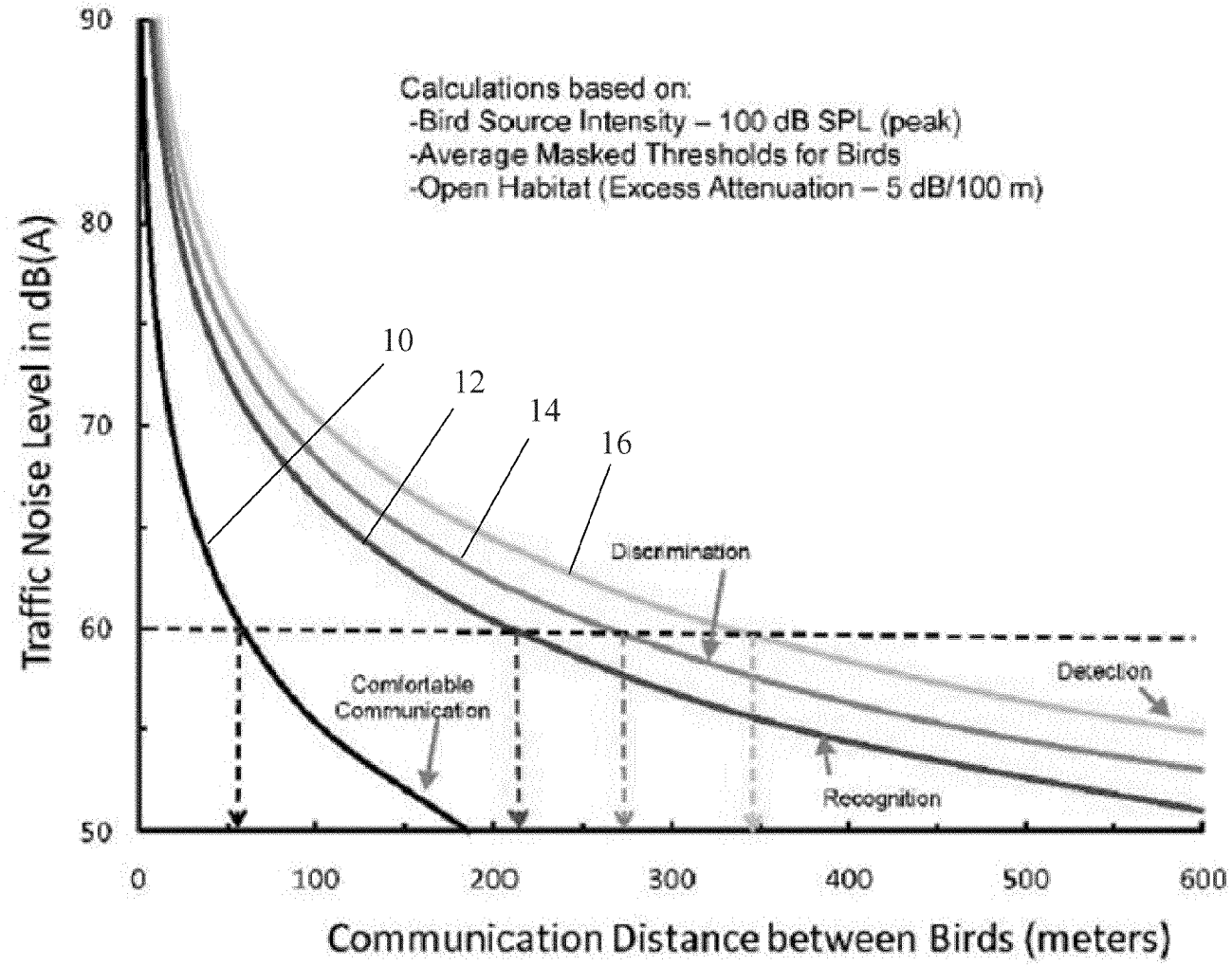
FIG. 2 graphically illustrates communication distance values computed for a 60 dB SPL (Sound Pressure Level) level of traffic noise.

FIG. 2 provide a graphical representation of the different categories of auditory communication behaviors, providing a relationship between the magnitude of the sound in decibels (dB) and the communication distance between individual birds in meters (m). The graph in FIG. 2 indicated that the decibel levels are A-weighted, which is commonly accepted in the context of sound measurement.

By way of background, A-weighting is a commonly used curve from a family of curves defined in, among other places, international standard IEC 61672:2003. A-weighting relates to the measurement of sound pressure levels as opposed to actual sound pressure. The A-weighting curve is commonly used for the measurement of environmental noise and industrial noise. It is also commonly used to assess potential hearing damage and other health effects at different sound levels. In many cases, A-weighting is mandated for measurement of many types of sounds.

FIG. 2 graphically illustrates communication distance values computed for a 60 dB SPL (Sound Pressure Level) level of traffic noise. This graph can be used to construct a receiver-centric map of distances corresponding to the four different auditory communication behaviors. There are four curves here. The left-hand curve represents a comfortable communication range for a bird. This curve is labeled "10" for ease of reference. The comfortable communication curve 10 illustrates the relationship between the distance from a vocal sender to an auditory recipient and the level of traffic noise. The next adjacent curve is the sound recognition curve 12. The next curve is the sound discrimination curve 14. The right-hand most curve is the sound detection curve 16. The meaning of these curves are discussed in connection with FIG. 3.

Figure 3:
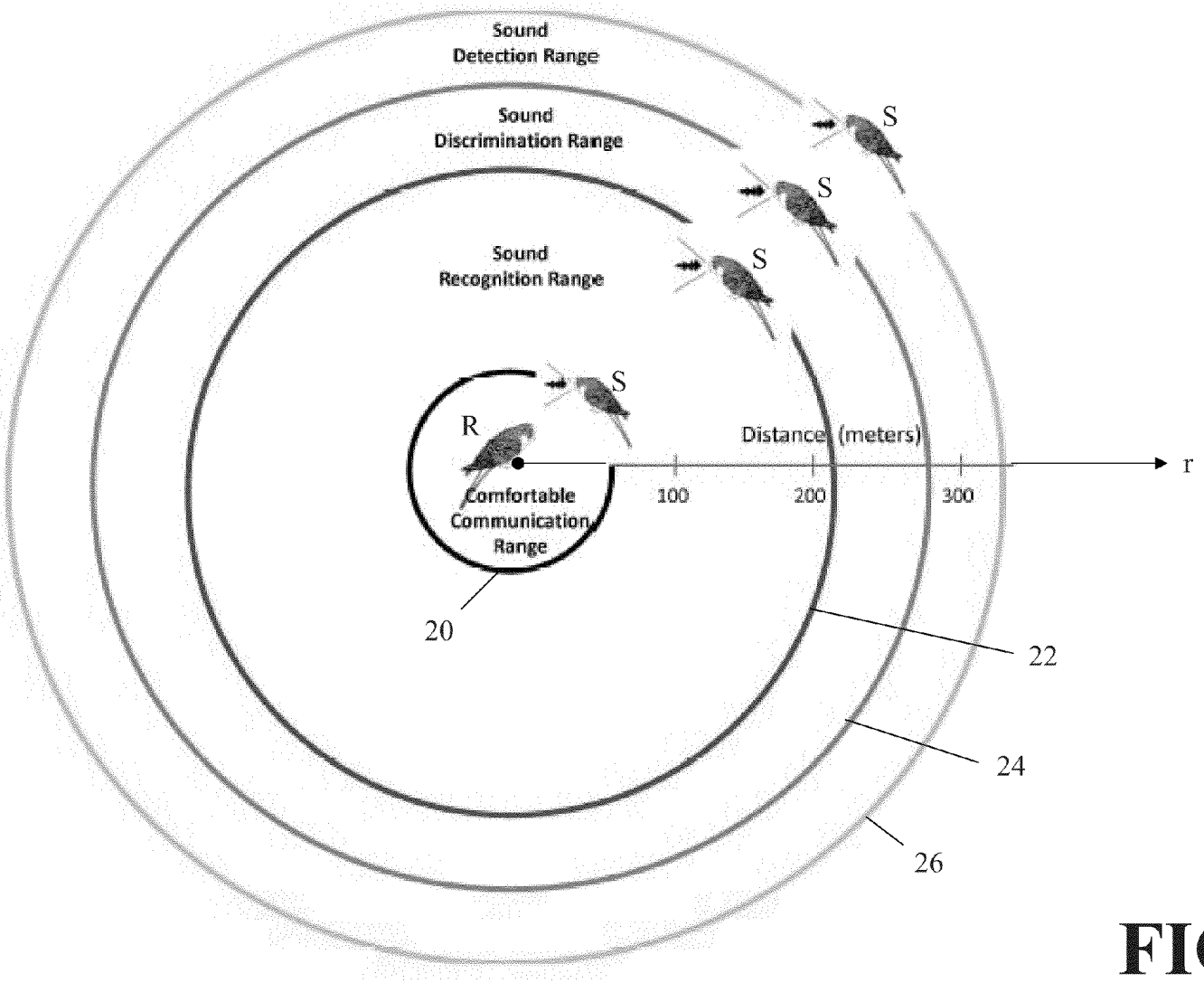
FIG. 3 provides a spatial diagram illustrating relative spatial relationships between a sender animal and a recipient animal and the four categories of sound perception ranges associated therewith.

FIG. 3 is based on the values provided in FIG. 2. FIG. 3 is the schematic representation of the receiver-concentric map of distances corresponding to the four different auditory communication behaviors that are graphically presented in FIG. 2. The distances in FIG. 3 correspond to the distances identified at 60 dB in FIG. 2.

In FIG. 3, the communication distance between the sender S (along the periphery) and receiver R (at the center) is represented as a radius "r" for each of the concentric circles defining the boundaries of each of the four levels of communication that are graphically represented in FIG. 2. While any increase in ambient noise level from anthropogenic sources can potentially affect acoustic communication, which auditory behaviors are affected depend on the noise level.

In FIG. 3, the inner circle represents the comfortable communication range 20, which is the case where the sender S is close to the receiver R. This represents a signal-to-noise ratio that is sufficiently large that the sender S and receiver R can communicate comfortably. As the sender S moves away from the receiver R, the signal level and therefore signal-to-noise ratio, at the receiver R drops. At the sound recognition range 22, the receiver R can no longer communicate comfortably but can recognize a sender's different vocalizations. If the sender S moves even further away, for example to the sound discrimination range 24, the receiver R can still discriminate between two vocalizations but cannot reliably recognize them. Finally, at the outer perimeter, which is the sound detection range 26, the signal level at the receiver R results in such a low signal-to-noise ratio that the receiver R can just detect that some kind of a sound has occurred. The distance over which masking from anthropogenic noise sources occurs can be quite large. This schematic provides a way of estimating and quantifying the risk to acoustic communication in birds at different distances from a noise source.

As indicated above with respect to FIG. 2, when the noise level is selected at 60 dB, taking into account the four categories of communication, it becomes possible to construct the concentric map provided in FIG. 3. As shown, with a 60 dB noise level, the comfortable communication range for the illustrated bird species is slightly greater than 50 m. The sound recognition range is slightly greater than 200 m. The sound discrimination range is about 275 m. Finally, the sound detection range is about 350 m.

As should be apparent from FIG. 2, the louder the noise level in the environment, the smaller the respective distances for each of these communication ranges. Consequently, the louder the noise level, the smaller will be the concentric circles if generated as shown in FIG. 3.

In real-world situations, the acoustic dynamics of signal transmission are highly variable, both spatially and temporally, depending upon distribution and character of habitat types, prevailing meteorological conditions and the relative behaviors of the sender S and receiver R. Consequently, the shapes and sizes of the communication regions around the receiver R will naturally vary in accordance with the physical conditions of the area, the species-specific hearing capabilities, and the strategies employed in communicating acoustically.

FIG. 3 shows how proximity to a linear noise source such as a highway would affect communication range in the simplest case of a uniform, open habitat. Communication distances for birds closer to the noise source, or with large critical ratios, would be represented by smaller concentric circles. Communication distances for birds further away from the noise source, or with smaller critical ratios, would be represented by larger concentric circles. This relationship is clearly identified in FIG. 2.

The impact of anthropogenic noise on communication in wildlife depends on: (1) the level of the noise but also its spectral composition, (2) the level and spectrum of the sender's vocalization at the receiver R, and (3) the receiver's species-specific auditory capabilities. Noise within the spectral band of the signal, if it rises above ambient levels, can mask these communication signals thereby degrading or eliminating effective communication between individuals.

In nature, the shape of the areas around the receiver R demarcating different auditory effects as shown in this model would actually be irregular polygons reflecting habitat-specific differences in excess attenuation (e.g., ground effects, temperature, signal scattering in vegetation, and other environmental effects) as well as the relative locations of the two birds and the receiver's distance from the noise source.

It is clear from FIGS. 2 and 3 that, for birds communicating close to a noise source where noise levels are high, the area of the effective communication will be reduced. This approach of considering communication from the standpoint of the receiver R may provide a useful metric for evaluating the actual noise impact on individuals, or collectively on populations, in areas subject to anthropogenic noise exceeding ambient levels. For instance, in determining risk to a species, the communication distances derived from this model might be considered in relation to other aspects of biology such as territory size.

As noted above, there is considerable interest in assessing the effects of anthropogenic noise on birds and other animal species. For example, from an environmentalist perspective, there is a desire to have the ability to quantify the amount of "sound pollution" in a particular location. Sound pollution refers to noise levels in a particular area, typically due to industrial or urban activity. Sound pollution is a concern for urban planners and industrial engineers alike, among other interested parties, for many reasons as should be apparent to those skilled in the art.

As may also be appreciated from the foregoing discussion, there is a need to be able to measure ambient sound conditions and assess the impact of the sound on local fauna. More specifically, there is a desire for one or more systems that may provide a reliable and repeatable methodology upon which the effect of the noise in a particular location may be analyzed and categorized. The results of this system and method can then be use to plan developments and/or assist with sound management to reduce the impact of sound on local fauna. The present invention addresses this need, among others.

Figure 4:
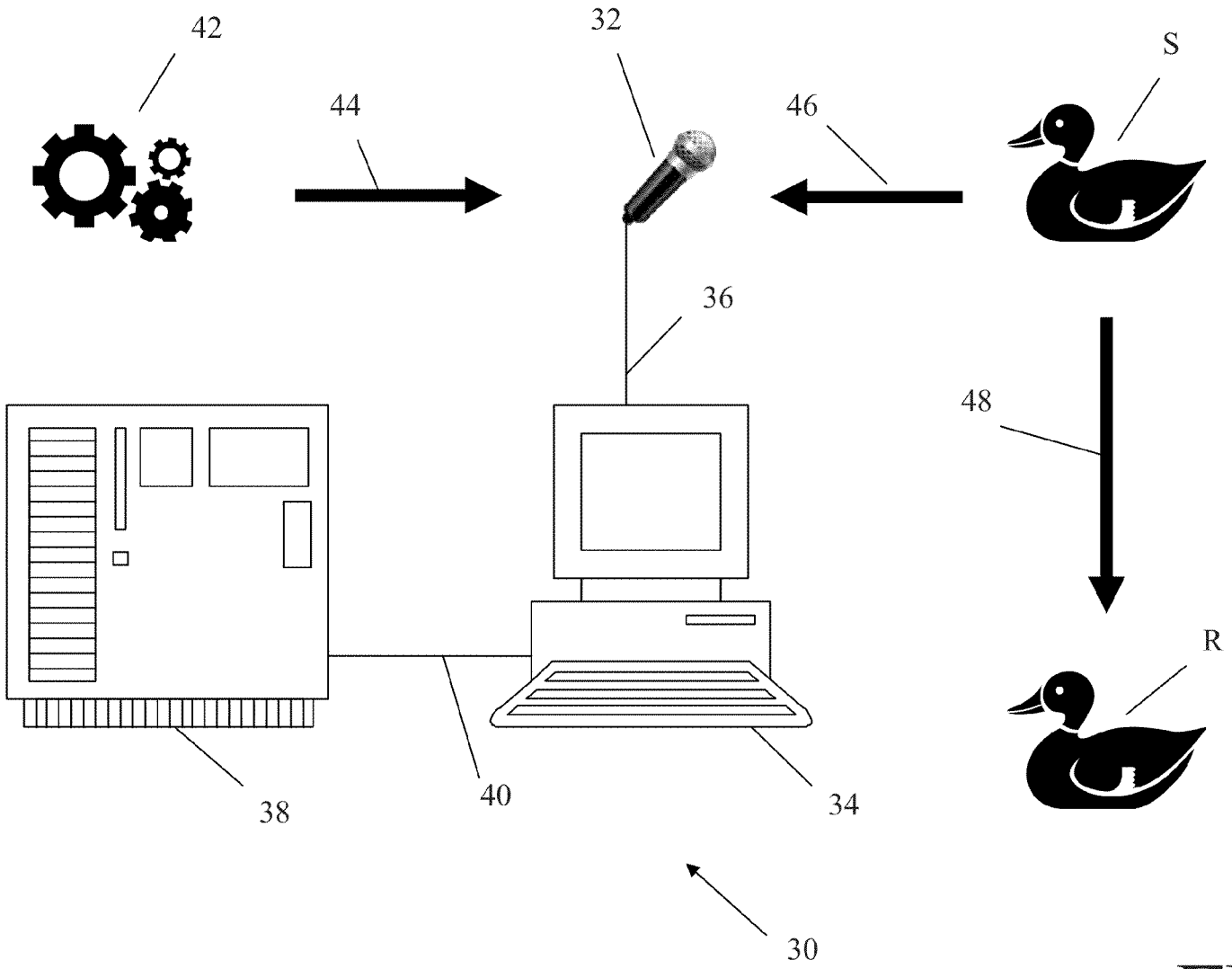
FIG. 4 is a schematic diagram illustrating the various components of the system of the present invention.
Figure 5:
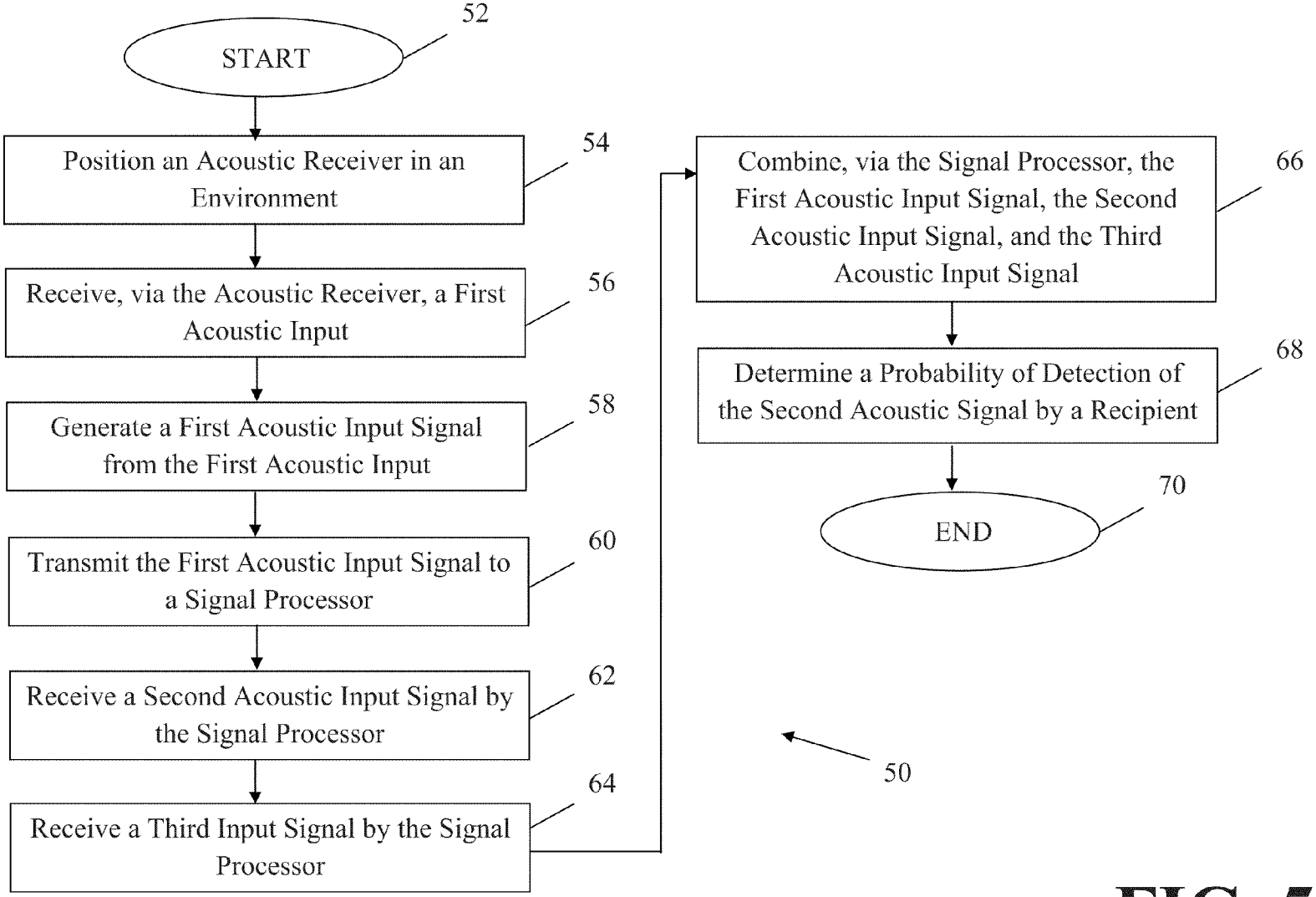
FIG. 5 is a flow chart illustrating one embodiment of the method of the present invention.

FIG. 4 provides a schematic diagram of one contemplated embodiment of the acoustic system 30 of the present invention. The system 30 includes one or more acoustic receivers 32 that are connected to a processor 34 via a connection 36. The processor 34, in turn, may be connected to a database 38 via a connection 40. The database 38 may be another processor, data bank, or memory containing one or more data types. As should be apparent to those skilled in the art, a separate database 38 is not required to practice the present invention. The database 38 may be incorporated into the processor 34. The database 38 may also be one or more memory files and need not be a separate piece of electronic hardware. As also should be apparent to those skilled in the art, the connections 36, 40 may be any suitable type including wired or wireless connections.

The system 30 is illustrated schematically as it might appear in a typical environment. FIG. 4, therefore, also illustrates a source of noise 42. Here, the noise source 42 is represented by several gears to indicate that the noise source is industrial or urban, for example. Also illustrated are two birds, a sender S and a receiver R. The arrows 44, 46, 48 are provided to illustrate the directions of sound within the environment. Specifically, the arrow 44 indicates the direction of sound from the noise source 42 to the acoustic receiver 32. The arrow 46 indicates the direction that sound travels from the sender S to the acoustic receiver 32. The arrow 48 indicates the direction of sound travelling from the sender S to the receiver R.

The method of the present invention will now be described in connection with FIGS. 4-7.

In a first contemplated embodiment of the present invention, the method 50 involves one or more operations and/or steps that model the effects of anthropogenic sound waves on a sound. The method starts at 52 in FIG. 5. From the start 52, the method proceeds to a step of positioning an acoustic receiver in an environment, which step is designated 54. The acoustic receiver 32 may be any type of acoustic receiver 32 as may be appreciated by those skilled in the art. Typically, the acoustic receiver 32 will be a suitable microphone capable of receiving acoustic inputs from the environment. The microphone may be directional or not. The environment is considered to be the selected ambient environment.

At the step identified as 56, the acoustic receiver 32 receives a first acoustic input. The first acoustic input is sound that exists in the environment, which includes the noise generated by the noise source 42. The first acoustic input includes at least a first magnitude and a first spectral composition. The magnitude refers to a quantum of sound, which is typically measured in decibels, as discussed above. The spectral composition denotes the acoustic properties of the sound, as should be appreciated by those skilled in the art. An acoustic spectrum or a sound spectrum typically refers to the distribution of the energy of the sound as a function of frequency. Of course, acoustic spectra can be defined in other fashions, as should be appreciated by those skilled in the art. With respect to step 56, the first acoustic input establishes a first baseline for sound waves existing in the environment. The first acoustic signal, therefore, may include ambient noise mixed together with urban and/or industrial noise 42, for example.

At step 58, a first acoustic input signal is generated from the first acoustic input. The first acoustic input signal is contemplated to be a digital signal. As should be apparent, however, the first acoustic input signal need not be digital but could be an analog signal, for example, that is later converted to a digital signal (or suitable alternative) for further processing by the processor 34, as discussed below.

The method 50 then proceeds to step 60, where the first acoustic input signal is, transmitted to a signal processor 34. As noted above, the signal processor 34 may be any type of processing device suitable for the present invention. As discussed, the signal processor 34 is anticipated to be a computer, such as a personal computer, laptop, or PDA. Of course, any suitable alternative may be employed without departing from the scope of the present invention.

At step 62, the method 50 includes the step of receiving a second acoustic input signal by the signal processor 34. Like the first acoustic input signal, the second acoustic input signal is contemplated to be a digital signal. The second acoustic input signal includes at least a second magnitude and a second spectral composition. Moreover, the second acoustic input signal establishes a second baseline for sound wave generation by a sender S. In other words, the second acoustic input signal is tied to the vocalization of the sender S of a sound. The sender S may be a bird, or other animal, as discussed in connection with FIGS. 3 and 4, for example.

Here, it is noted that the second acoustic input signal is not tied directly to one or more sounds received by the acoustic receiver 32, as is the first acoustic input. It is contemplated that the second acoustic input signal may be the result of a prior sampling of a second acoustic input from the sender S. The second acoustic input may have been pre-recorded or may have been selected from a look-up table resident in the database 38, for example.

In this regard, it is contemplated that the method 50 of the present invention may incorporate one or more look-up tables. A look-up table may encompass one or more databases 38 that may be available to the processor 34. The look-up table may include acoustic samples from a wide variety of species of senders, which inputs may be selected by the user.

Alternatively, the acoustic receiver 32 may be used to receive a second acoustic input in the same manner that it receives the first acoustic input. In other words, the acoustic receiver 32 may record one or more vocalizations from a sender S. In this regard, it is noted that the system 30 may be adaptable over a period of time as additional vocalizations are recorded and stored. As additional inputs are received by the acoustic receiver 32, a database may be generated by the processor 34. That database may then be available for subsequent analyses.

With respect to the interaction between the acoustic receiver 32 and the processor 34, as indicated above, it is anticipated that the signals processed by the processor 34 will be digital signals. As a result, it is contemplated that the acoustic signals may be transformed into digital signals by the acoustic receiver 32. Alternatively, the acoustic signals may be provided in an alternate format to the processor 34 where the signals are transformed into digital signals for further processing.

At step 64, the method 50 receives a third input signal by the signal processor 34. The third input signal includes at least a quantification of auditory sensitivity by a recipient R. It is anticipated that this information will be provided to the processor 34 from a suitable database, 38 since the third input concerns the auditory sensitivity of the recipient R. This data may be collected in advance of the implementation of the method 50. Alternatively, this data may be collected together with the collection of the acoustic data in a manner consistent with acceptable practices.

If suitable data are not in the published literature, recipient sensitivity data can be collected by standard behavioral and physiological methods for testing hearing in animals, as should be appreciated by those skilled in the art.

With respect to the third input signal, it is contemplated that the signal may be a value established with respect to a baseline consistent with the species or it may be established from a representative population of birds within the selected environment. Other methods for establishing the third input signal also may be employed.

It is noted that auditory sensitivity, which underlies the third input signal, is not necessarily merely a sensitivity to a quantum (measured in decibels, for example) of sound. To the contrary, auditory sensitivity also involves sensitivity to a range of frequencies (i.e., the acoustic spectrum) in quiet or in the presence of background noise. For example, if a particular bird species can hear sound only within a particular band of frequencies, this information also may be taken into account. Clearly, a bird species that is effectively "deaf" to certain urban noises will fare better in an urban environment than a species that is sensitive to frequencies of noise that are prevalent in a urban environment.

When the third input signal is a value established with respect to a baseline consistent with the species, this indicates that the third input value will be selected as a value or from a group of values (i.e., from a database) that establishes a common auditory sensitivity for a particular species. This baseline may represent an average or median sensitivity for the species. Alternatively, the third input signal may be established for a representative population of birds within the selected environment. It is also anticipated that there may be a reduced sensitivity to sound for a local population due, perhaps, to prolonged exposure to PTS sound. As a result, the third input signal may be established for a local population of birds so that the comparison more accurately reflects the acoustic sensitivity of the local population. In still a further contemplated embodiment of the present invention, the third input signal may be calculated from a baseline number for the species as a whole, taking into account hearing degradation that would be expected for a species living within a selected geographic environment.

In still another contemplated embodiment of the present invention, it is contemplated that the method may be employed to calculate variables for several species of birds within a particular environment. In other words, the method may address the inputs for each of the species that are known to inhabit a particular locus.

It is also contemplated that the birds resident in a local environment may be considered as a group by creating a computer model of a single bird species that is representative of the various individuals in the environment. In this example, the acoustic sensitivities of the different species may be averaged together to establish an average for all of the birds within the environment. This average may then be used to establish the third acoustic input.

Regardless of how the third input signal is determined, the method 50 proceeds to step 66 where the signal processor 34 combines the first acoustic input signal, the second acoustic input signal, and the third input signal to produce a comparison signal. The comparison signal may reflect any number of different parameters. For example, the comparison signal may include a comparison between the first spectral composition of the first acoustic input and the second spectral composition of the second acoustic input. As should be apparent to those skilled in the art, acoustic spectra (as with other spectra) can interfere with one another so that the amplitude of selected frequencies is either reduced or enhanced. A spectral comparison may take this effect into account. In addition, the first magnitude of the first acoustic input and the second magnitude of the second acoustic input may be compared with one another to establish at least a portion of the comparison signal. Other aspects of the first and second acoustic inputs also may be compared with one another to result in the comparison signal, as should be apparent to those skilled in the art.

With respect to the comparison of acoustic spectra and their interaction with one another, it is noted that noise frequencies and vocalization frequencies may interact with one another to produce sounds that become unrecognizable to the recipient R even though the sound can be heard by the recipient R. For example, it is contemplated that a noise spectrum might interfere with a vocalization spectrum to mask out specific frequencies within the vocalization. If enough of the frequencies are masked, the recipient R may not recognize the vocalization at all. Spectral comparisons, therefore, may provide valuable information in a particular implementation of the methods of the present invention.

Returning to FIG. 5, the method 50 proceeds to step 68 where, based on the comparison signal, a probability of detection of the second acoustic signal by the recipient is determined. This determination is made at least by taking into account the recipient's acoustic sensitivity, among other factors as discussed above.

As noted above, the second acoustic signal may be provided to the processor 34 from a database 38. In this example, the second acoustic signal may be pre-recorded from the sender S. Alternatively, the second acoustic signal may be representative of one or more individuals within a selected bird species. As noted above, the second acoustic signal may be captured directly via the acoustic receiver 32. Regardless of how it is captured, the second acoustic input includes at least the second magnitude and the second spectral composition. The second acoustic input establishes the second baseline for sound wave generation by the sender S. As with the first acoustic input, the second acoustic input signal is generated based on the second acoustic input. The second acoustic input signal is then transmitted to the signal processor 34.

The discussion of the present invention now turns to the measurement of distances between the noise source 42, the sender S, and the recipient R. For purposes of the present invention, distances may be measured, calculated, estimated, or assumed. Distances also may include a combination of measurements, calculations, estimates, or assumptions, as should be appreciated by those skilled in the art.

In one contemplated embodiment of the present invention, the distances between the noise source 42, the sender S, and the recipient R may be estimated and/or calculated based on the magnitudes of the sounds and or the acoustic spectra. Moreover, even where the actual distances cannot be determined, the relative magnitudes of the sounds at the acoustic receiver 32 provides sufficient information for a comparison to be made between the first acoustic input and the second acoustic input. Alternatively, distances may be assumed to be 1 m, 10 m, 20 m, 50 m, 100 m, etc., as may be appropriate for the calculations. In a typical circumstance where assumed distances are used, distances of 1 m from the source is considered to be an acceptable assumption in many cases.

For more accurate calculations to be made, it is contemplated that, in one or more variations of the method 50 of the present invention, distances will be taken into account as will an attenuation factor.

Figure 6:
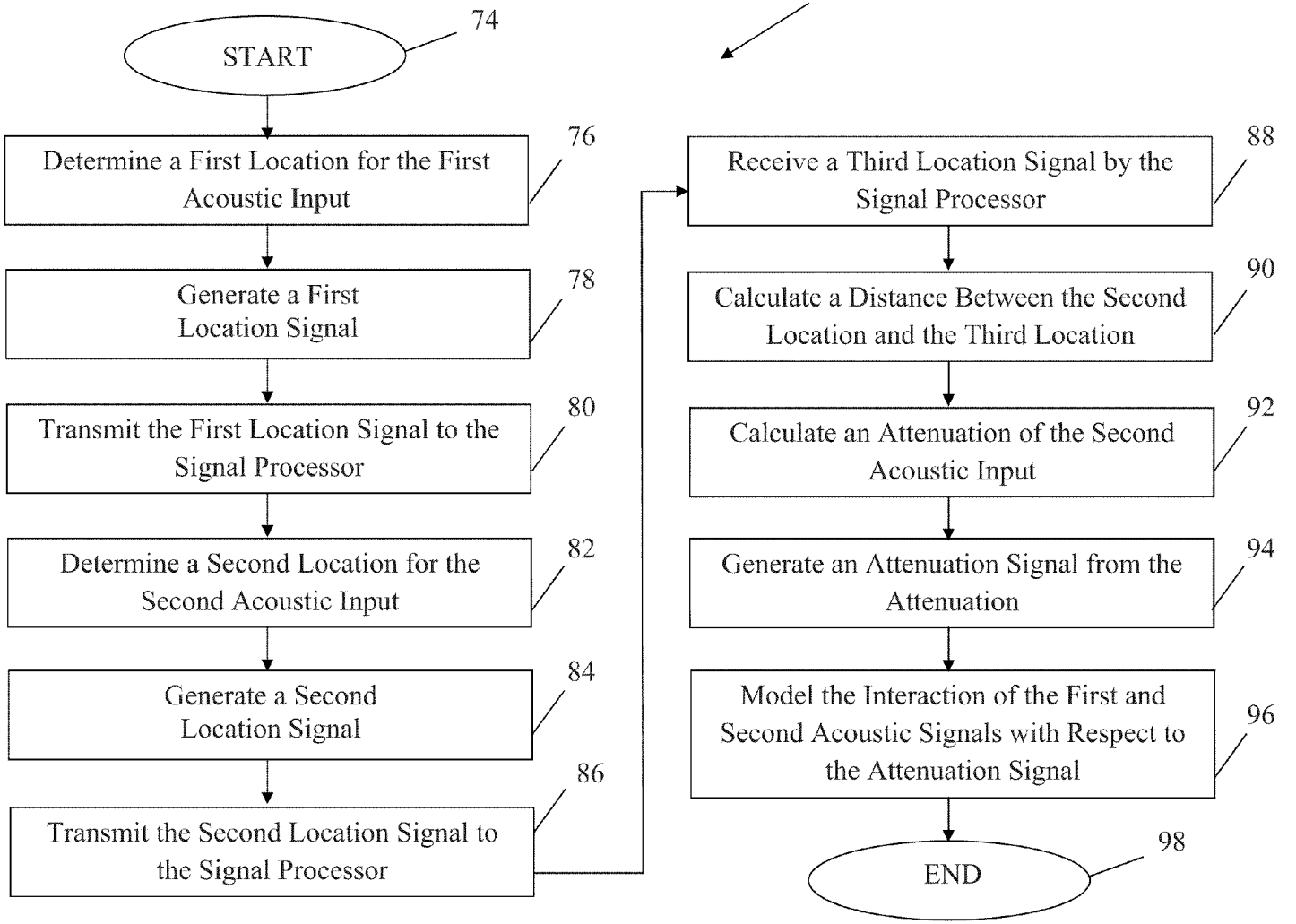
FIG. 6 is a flow chart illustrating details of a second embodiment of the method of the present invention.

FIG. 6 illustrates a method 72 that is contemplated to be used in conjunction with the method 50. If so, the method 72 may be inserted in its entirety between steps 64 and 66. Alternatively, the steps may be interspersed throughout the steps of the method 50, as desired.

The method 72 modifies the method 50 by adding the following steps. The method 72 begins at 74. If run as a contiguous series of steps, the method 72 is contemplated to proceed to step 76 where a first location for the first acoustic input is determined. The method 72 then proceeds to step 78 where a first location signal is generated. At step 80, the first location signal is transmitted to the signal processor 34. At step 82, a second location is determined for the second acoustic input generated by the sender S. Then, at step 84, a second location signal is generated. The second location signal is transmitted to the signal processor 34 at step 86.

The method 72 proceeds to step 88 where the signal processor 34 receives a third location signal representative of the recipient at a third location. The signal processor then calculates a distance between the second location and the third location at step 90. At step 92, the signal processor 34 calculates an attenuation of the second acoustic input taking into account at least the first acoustic input and the distance. When calculating the attenuation, other variables also may be taken into account, including the first acoustic input, its spectrum and magnitude, for example. Then at step 94, the signal processor 34 generates an attenuation signal from the attenuation. At step 96, when comparing the first acoustic input signal, the second acoustic input signal, and the third input signal, the signal processor 34 models the interaction of the first acoustic signal and the second acoustic signal with respect to the attenuation signal. The method 72 ends at 98.

With respect to the method 72, it is contemplated that the sender S is positioned at the second location. This is true for the method 50 as well.

Figure 7:
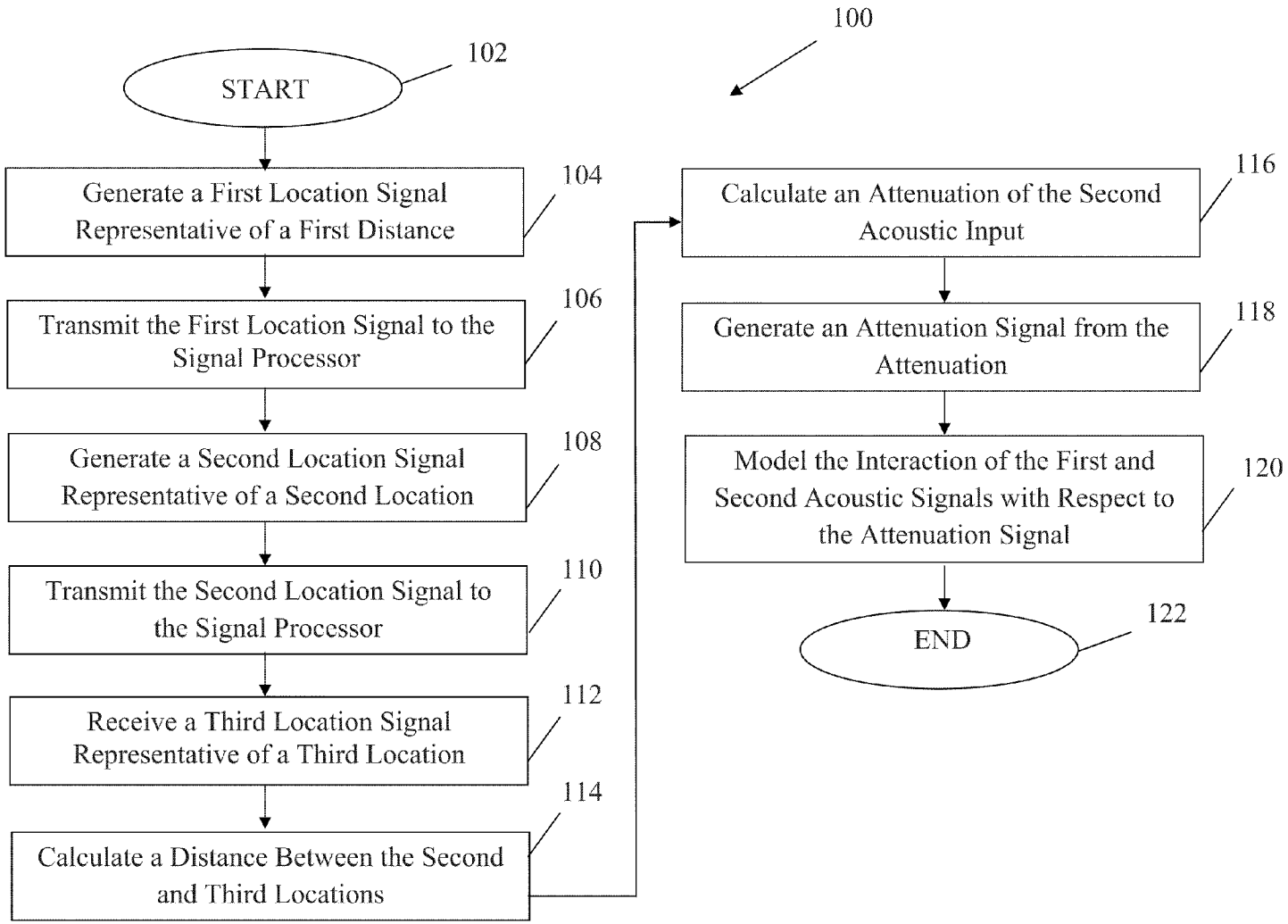
FIG. 7 is a flow diagram illustrating details of a third embodiment of the method of the present invention.

FIG. 7 illustrates a method 100 that is contemplated to be used in conjunction with the method 50. If so, like the method 72, the method 100 may be inserted in its entirety between steps 64 and 66. Alternatively, the steps may be interspersed throughout the steps of the method 50, as desired.

FIG. 7 provides a further modification of the method 50. This method 100 starts at 102. At the step identified as 104, a first location signal representative of a predetermined first distance is generated from the acoustic receiver 32 to the first acoustic input. Then, at step 106, the first location signal is transmitted to the signal processor 34. At step 108, a second location signal representative of a predetermined second distance is generated from the acoustic receiver 32 to the second acoustic input. At step 110, the second location signal is transmitted to the signal processor 34. Then, at step 112, the signal processor 34 receives a third location signal representative of the recipient at a third location. At step 114, the signal processor 34 calculates a distance between the second location and the third location. The signal processor 34 also calculates an attenuation of the second acoustic input, taking into account at least the first acoustic input and the distance. This calculation is identified as step 116. At step 118, an attenuation signal is generated from the attenuation. Then, at step 120, when comparing the first acoustic input signal, the second acoustic input signal, and the third input signal, the interaction of the first acoustic signal and the second acoustic signal are modeled with respect to the attenuation signal.

The method of the present invention also contemplates that the predetermined first distance from the acoustic receiver 32 to the first acoustic input is at least 1 meter and that the predetermined second distance from the acoustic receiver to the second acoustic input also is at least 1 meter. In this embodiment, the distances are assumed to be predetermined values for purposes of the calculations. The distance need not be one meter. To the contrary, the predetermined distances may be assumed to be 2 m, 5 m, 10 m, 20 m, 50 m, 100 m, etc.

With respect to the methods 72 and 100, for example, the actual distances may be measured and inputted. Alternatively, the distances may be estimated. As noted above, the database 38 may include data concerning vocalizations for a particular species. If the data indicates that a species vocalizes at, for example, 80 dB, and the receiver 32 detects the vocalization at 70 dB, it is possible to estimate the distance from the receiver 32 to the sender S. Other methods also may be employed without departing from the scope of the present invention.

In one variation of the present invention, the first baseline for sound waves in the environment includes noise existing in the environment.

In another variation, the second baseline for sound wave generation by the sender S includes a vocalization by the sender S. As indicated above, the second baseline may be based, at least in part, on characteristics of the species. It is contemplated that the second baseline will encompass a number of variables.

In addition, it is contemplated that the sender S and the recipient R encompass at least one species from the animal genus. As discussed above, that species is contemplated to encompass birds.

It is also contemplated that the sender S and the recipient R may be different species from the animal genus.

The present invention also contemplates that the first acoustic input includes ambient environmental sound in addition to noise.

Moreover, when comparing the first acoustic input signal, the second acoustic input signal, and the third input signal, the first acoustic input signal and the second acoustic input signal are compared with the third input signal to determine if one or both of the first acoustic input and the second acoustic input exceed a threshold for auditory detection by the recipient R. Models of comparison are explained below in connection with the discussion of FIGS. 8-14.

FIGS. 8-14 provide flow charts that define aspect of a program, executable on a processor, that assist with quantifying and analyzing noise in a particular environment. With respect to the definition of a "processor," this term is intended to encompass any type of device that can receive information and execute code to produce an output. While a computer is envisioned to implement the method of the present invention, it is noted that a computer is not required to practice the invention. Any alternative processor may be employed without departing from the scope of the present invention. For example, the executable instructions may be performed in a personal data assistant (also referred to as a "PDA"), a cell phone, or other hand-held device. Moreover, to the extent that the method may be performed distinctly from a processor, the present invention is intended to encompass such use as well.

FIGS. 8-14 each are discussed in connection with four modes of operation: (1) user activity, (2) model activity, (3) model computation, and (4) model output. These four modes of operation are meant to encompass, but not be limited to the following.

User input is intended to refer to manipulation or data entry by a user. This may include selection of a particular input variable or selection of a feature that triggers a particular calculation, for example. User input may be triggered by a button on the device or may be initiated via a drop-down menu, for example.

Model activity refers, generally, to data retrieval, typically from a database, such as the database 38 illustrated in FIG. 4. Model activity also may refer to activity such as saving a particular data or group of data to a memory file or a database. Alternatively model activity may include playback of a recorded vocalization. Model activity is intended to refer to, but not be limited to, activity by the signal processor 32 that does not necessarily include calculation of a particular variable. Particular instances of model activity are discussed in connection with FIGS. 8-14 and help to define this parameter of the present invention. Model activity, however, is not limited to the specific instances described herein.

Model computation is intended to refer to activities of the signal processor to calculate a particular result. This may include setting variables to particular values, whether calculated, assumed, estimated, or inputted, for example.

Model output is intended to refer to the various outputs that result from the model computation. As will be made apparent from the discussion that follows, the model output is not limited to computational results. It may also include data output in one or more forms. Output encompasses, for example, payback of a recorded vocalization by a sender S.

Figure 8:
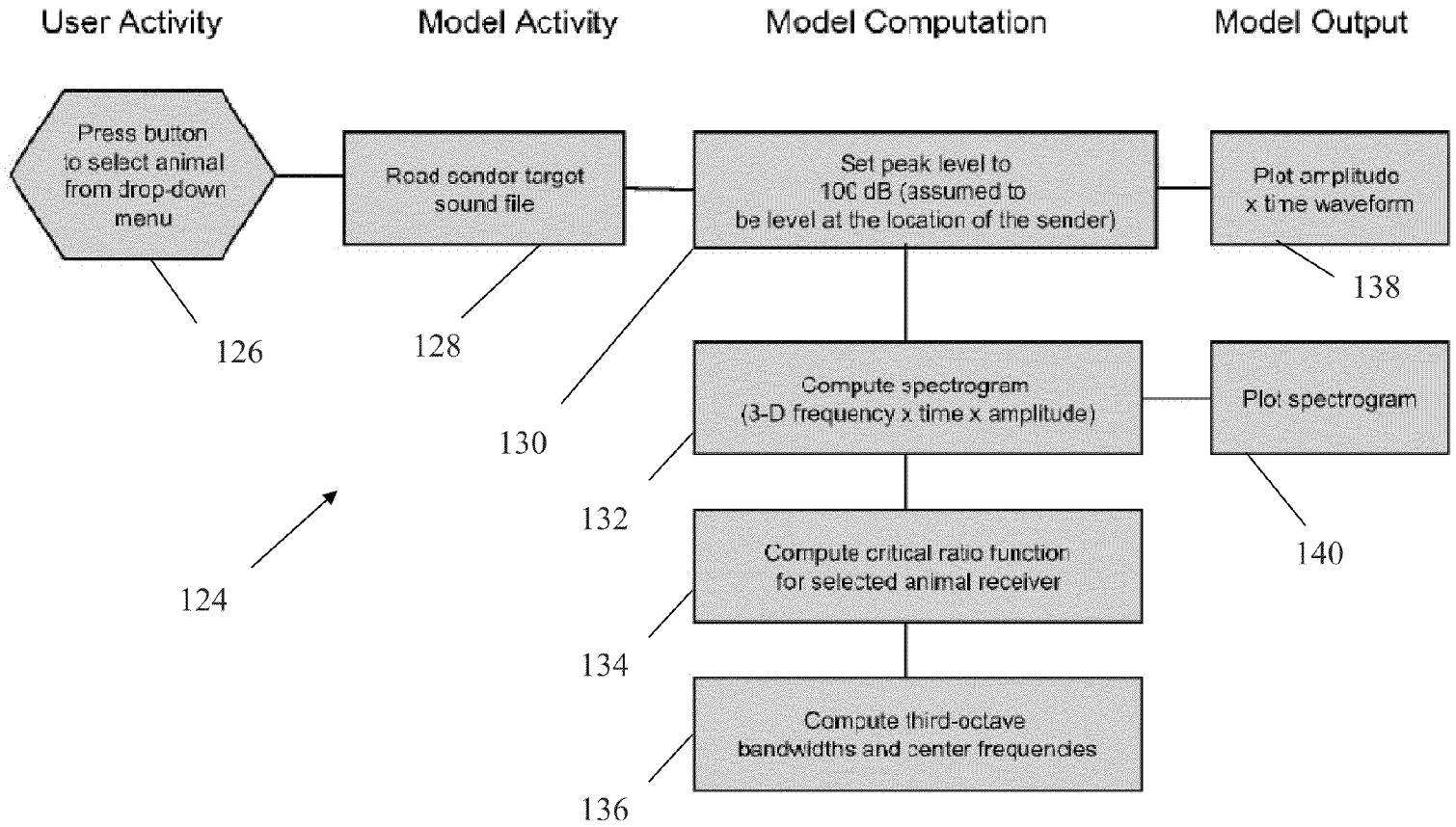
FIG. 8 is a flow diagram embodying a first contemplated instruction set that may be incorporated into the method of the present invention.

FIG. 8 illustrates a first embodiment of a set of instructions 124 contemplated for execution by the signal processor 32. This set of instructions 124 begins with a selection 126 of an animal species from a drop-down menu. This set of instructions 124, therefore, relies on a preset group of animal or bird selections, as discussed above, and may be expanded as more data becomes available.

After a user selects a particular species of birds at 126, a sender S target sound file is read at 128. As noted above, the sound file associated with the sender S may be read from a database 38 or may be read from a file creates with a sampling of the sender's sound, as recorded by the acoustic receiver 32. After the target file is read, the executable set of instructions 124 transitions to the model computation phase. In the model computation phase, at step 130, a peak level is set to 100 dB, which is assumed to be the level of sound at the location of the sender S. In particular, this level is set as the peak level of sound at the location of the sender S. With the peak level set to 100 dB, the signal processor 32 may proceed to step 138 and provide model output. At step 138, the model output is a plot of an amplitude of sound versus time. As may be appreciated this is an output of one type of waveform.

From step 130, the model computation may proceed to step 132, where the signal processor 32 computes a spectrogram in three dimensions (frequency, time, and amplitude). After computing the spectrogram, the signal processor 32 may produce an output which may be plotted at step 140.

Figure 9:
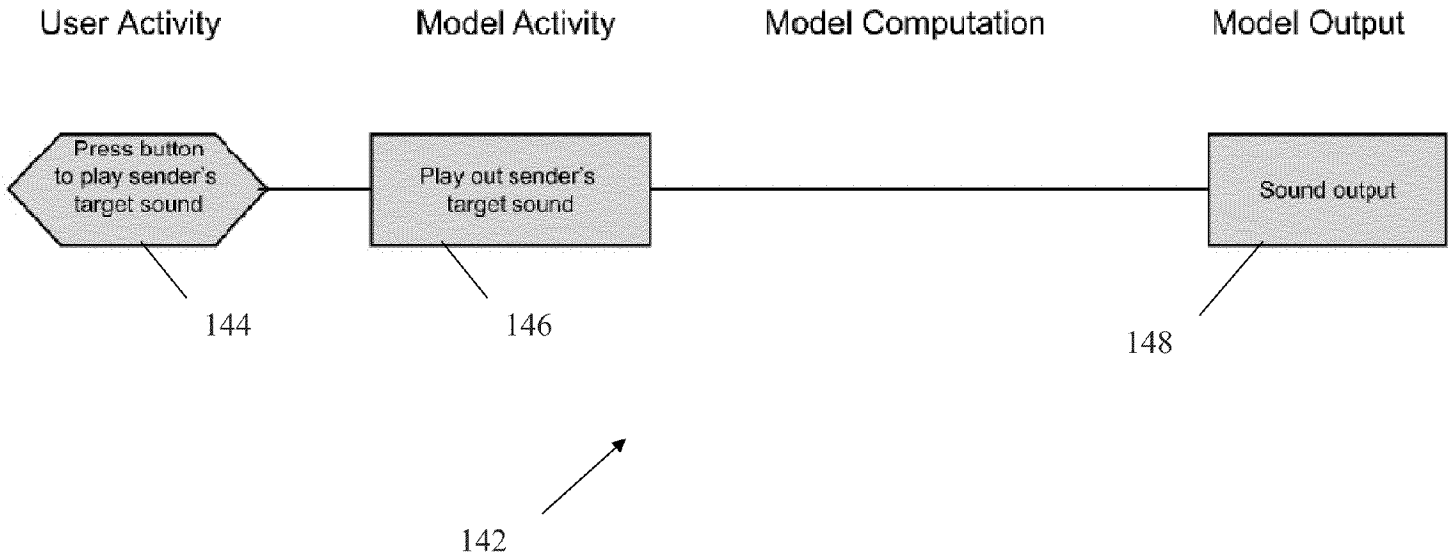
FIG. 9 is a flow diagram embodying a first contemplated instruction set that may be incorporated into the method of the present invention.

Alternatively, from step 132, the executable instructions may proceed to step 134 where the signal processor 32 computes a critical ratio function for a selected receiver R animal. If the executable instructions proceed to step 134, the instructions may also proceed to step 136 where third-octave bandwidths and center frequencies are computed by the processor 32. FIG. 9 illustrates a further aspect of the present invention, which is an instruction set 142 concerning a playback function. Here, the user selects a target sound at step 144. In the model activity function, the target sound of the sender S is retrieved at step 146. The sound is played back at step 148.

Figure 10:
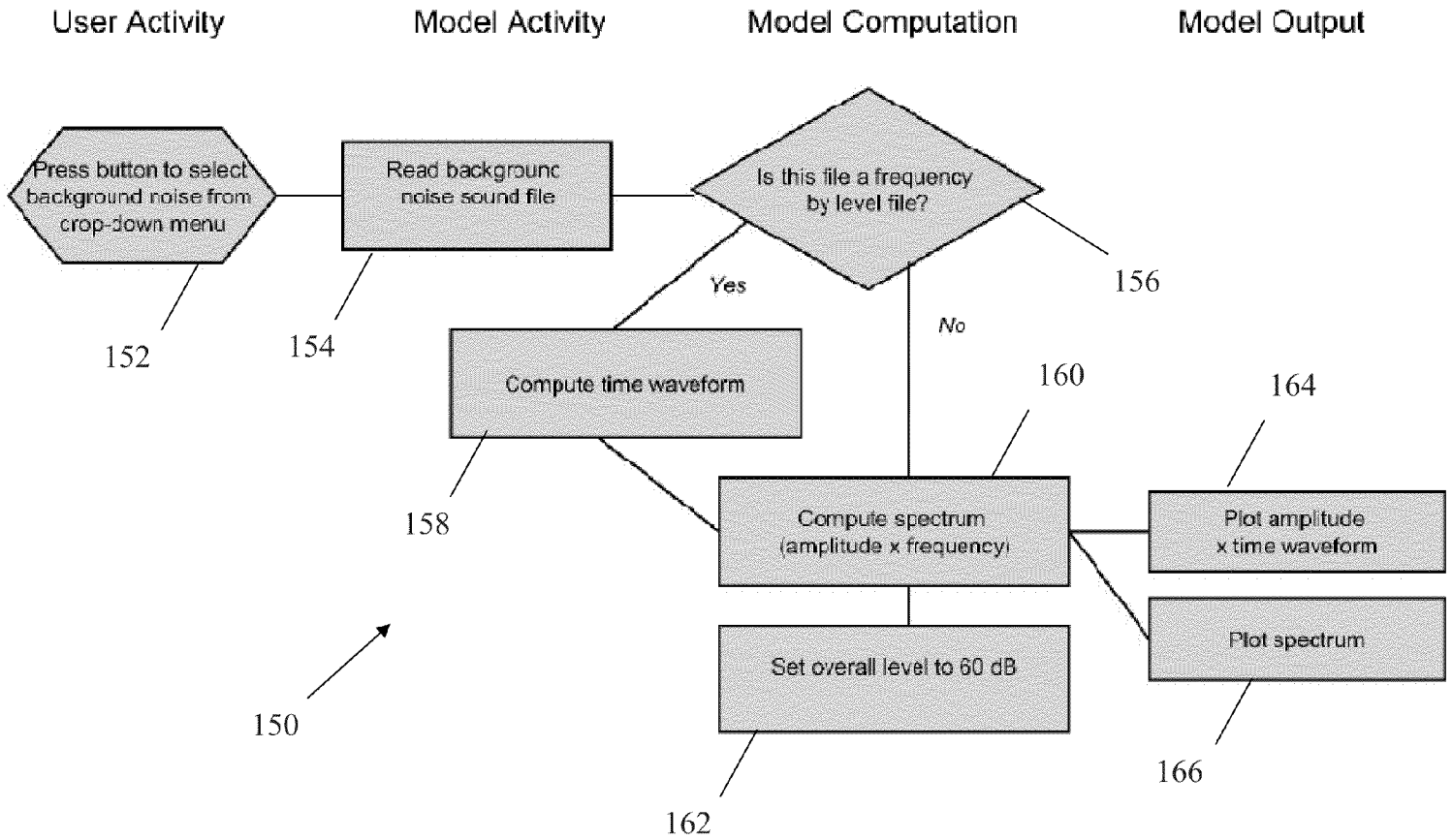
FIG. 10 is a flow diagram embodying a second contemplated instruction set that may be incorporated into the method of the present invention.

FIG. 10 illustrates an instruction set 150. In this instruction set 150, the user may select background noise from a drop-down menu at step 152. Once selected, the processor 32 reads data from a background noise file at step 154. The processor 32 then proceeds to step 156, where the processor 32 determines if the background noise sound file retrieved at step 154 is a file containing a frequency by level array of values. If the answer to this inquiry is "yes," the instruction set 150 proceeds to step 158, where the signal processor 32 computes a time waveform from the background noise sound file. The instruction set proceeds to step 160. If the answer to the question posed in step 156 is "no," then the instruction set 150 proceeds to step 160, where the signal processor 32 computes a spectrum of an amplitude versus a frequency of the background noise sound file. From step 160, a plot of the waveform of amplitude versus the time may be generated at step 164. Alternatively, a spectrum may be plotted at step 166. Alternatively, the instruction set 150 may proceed to step 162 where the overall level is set to a preselected value, for example, 60 dB. From this step, the processor may return to instruction set 124, for example, and process the data using the preselected overall noise level.

Figure 11:
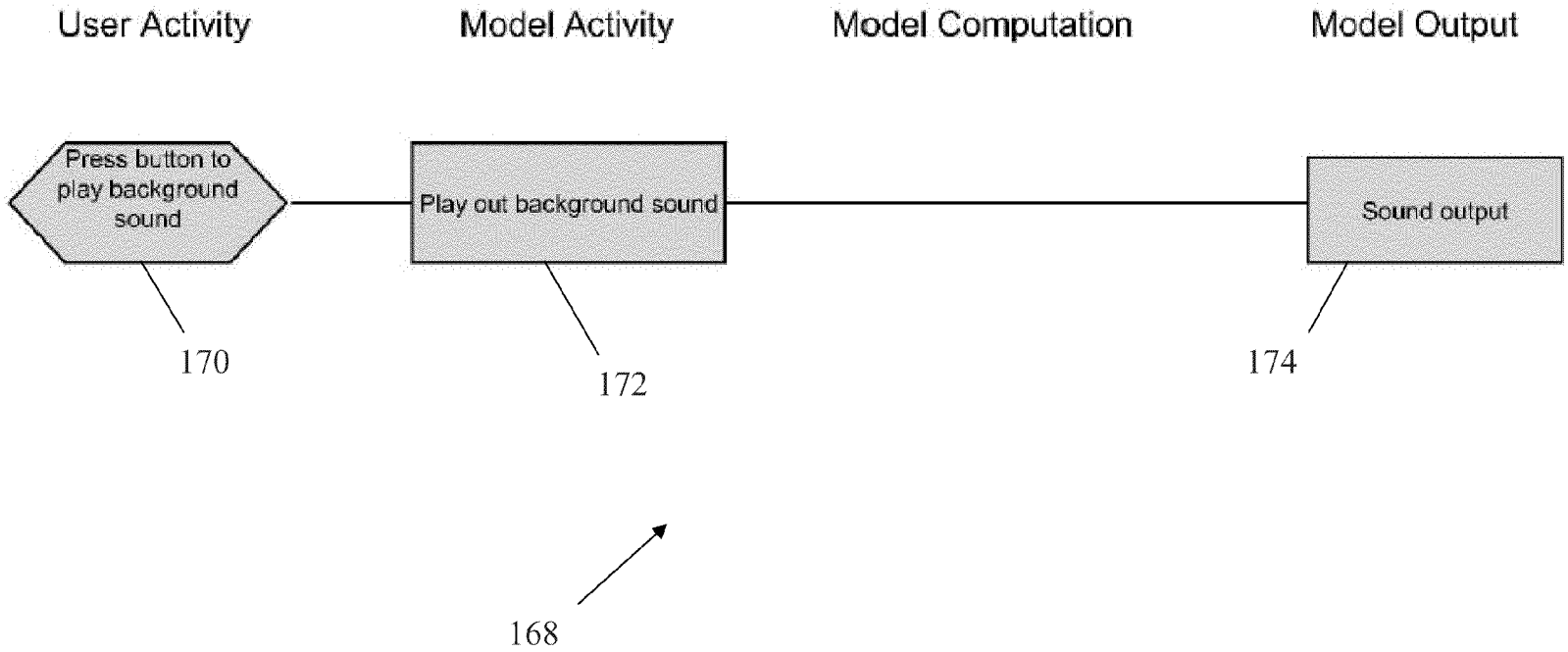
FIG. 11 is a flow diagram embodying a third contemplated instruction set that may be incorporated into the method of the present invention.

FIG. 11 illustrates a further aspect of the present invention, which is an instruction set 168 concerning a playback function, similar to the instruction set 142 illustrated in FIG. 9. Here, the user selects a background sound at step 170. In the model activity function, the background sound is retrieved at step 172. The sound is played back at step 174.

Figure 12:
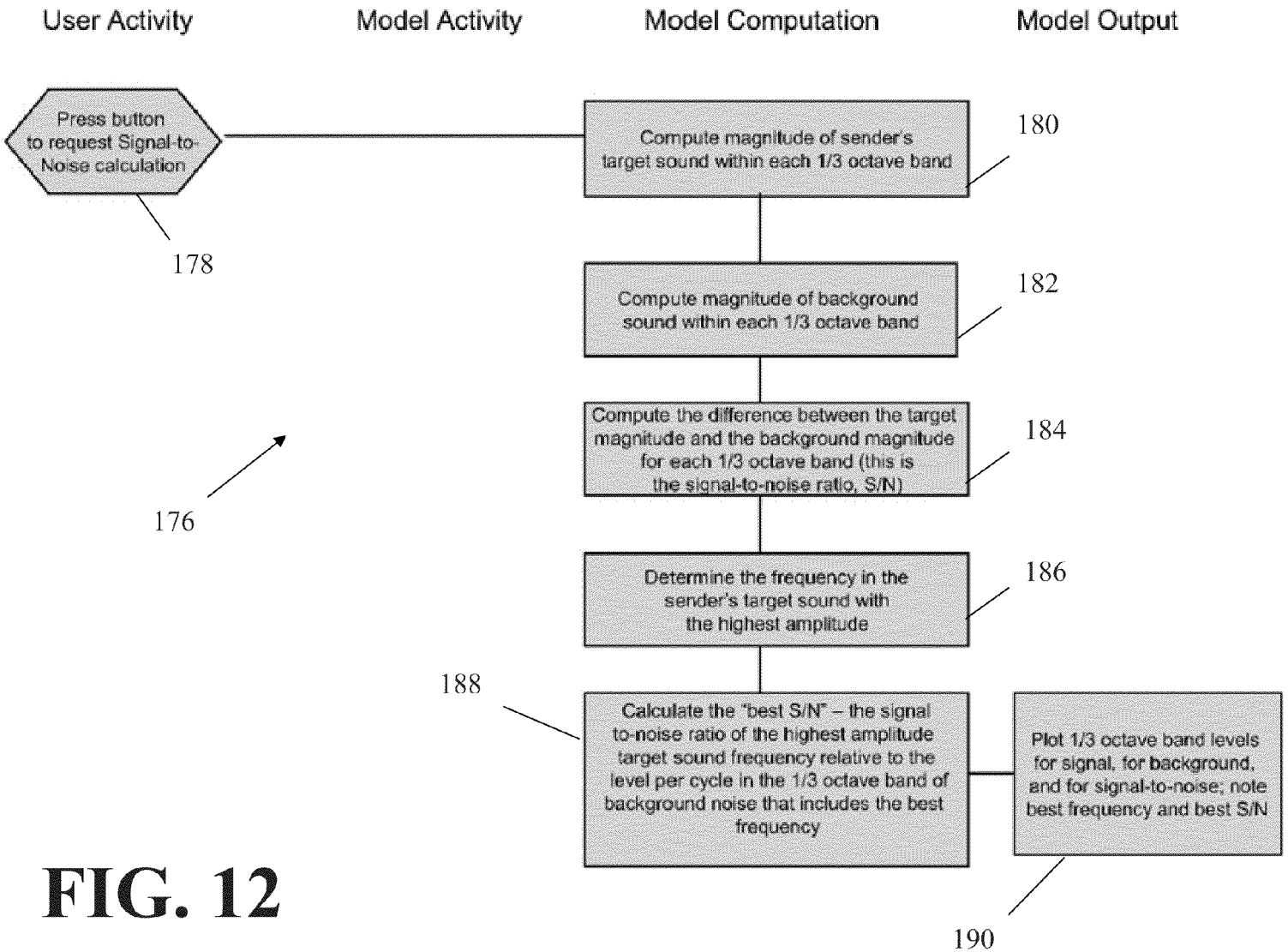
FIG. 12 is a flow diagram embodying a fourth contemplated instruction set that may be incorporated into the method of the present invention.

FIG. 12 provides a flow chart for an instruction set 176. Here, the user may initiate this instruction set 176 by selecting the calculation of a signal-to-noise ratio. If this option is selected, the signal processor computes the magnitude of a sender's target sound within each ⅓ octave band at step 180. From step 180, the instruction set 176 proceeds to step 182 where the signal processor computes the magnitude of the background noise within each ⅓ octave band. At step 184, the processor 32 computes the difference between the target magnitude and the background magnitude in decibels for each ⅓ octave band. This establishes a signal-to-noise ratio (also referred to as "S/N ratio"). The instruction set 176 then proceeds to step 186 where the processor 32 determines the frequency in the sender's target sound with the highest amplitude. Once this is determined, the method proceeds to step 188. In step 188, the processor 32 calculates the "best" S/N ratio, which is the signal-to-noise ratio for the highest amplitude target sound frequency relative to the level, per cycle in the ⅓ octave band, of background noise that includes the best frequency. From this step, the method proceeds to step 190 where a plot of the ⅓ octave band levels if created for the signal, the background, and for the signal-to-noise ratio. In other words, the processor 32 plots the best frequency with respect to the best signal-to-noise ratio.

Figure 13:
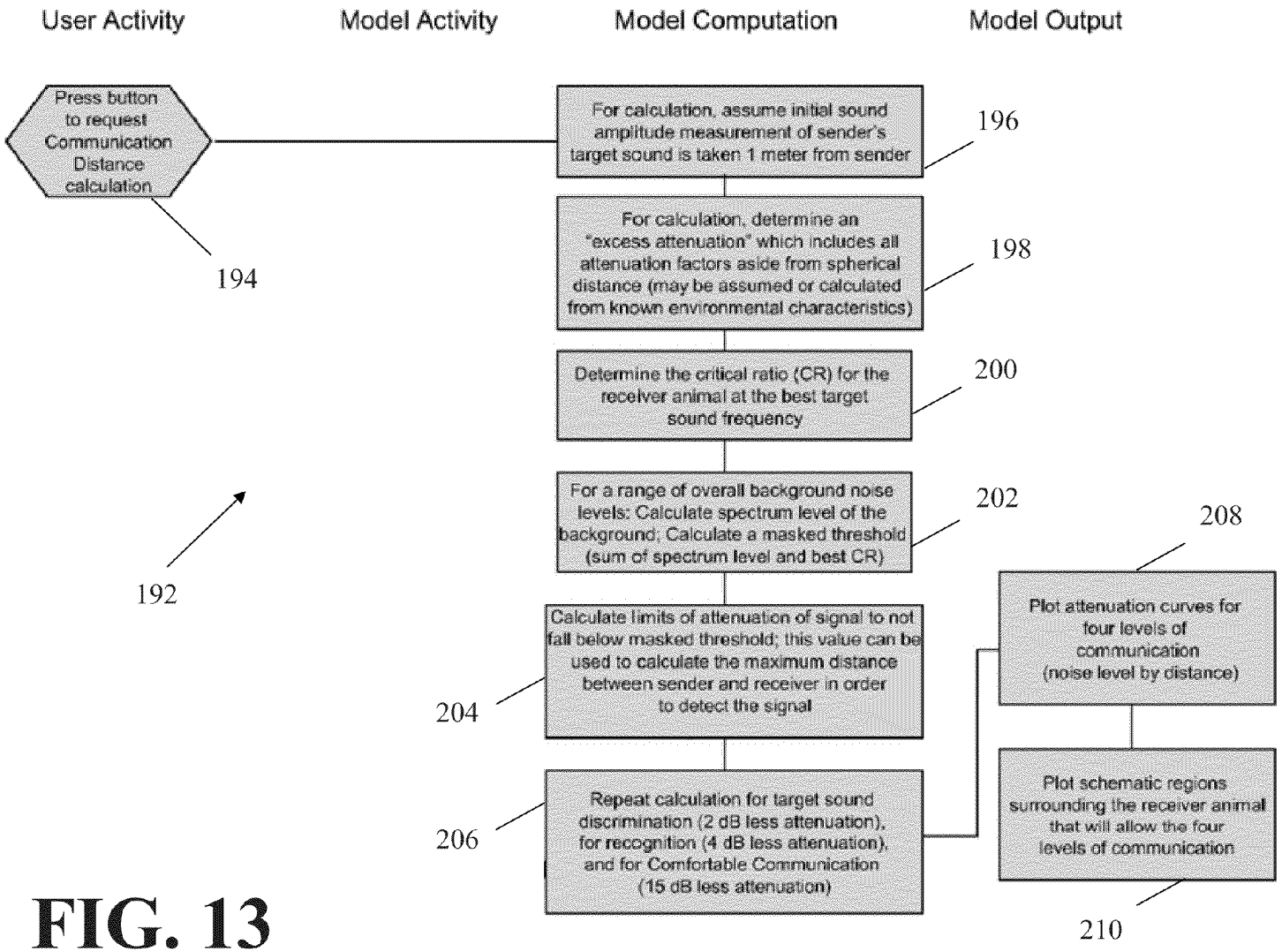
FIG. 13 is a flow diagram embodying a fifth contemplated instruction set that may be incorporated into the method of the present invention.

FIG. 13 illustrates an instruction set 192. In this instruction set, the user presses a button to request calculation of a communication distance at step 194. The instruction set 192 then proceeds to step 196 where the processor 32 assumes, for purposes of the calculation, that the initial sound amplitude measurement of the sender's target sound was taken at a distance of one meter from the location of the sender S. This simplifies the calculation, as should be appreciated by those skilled in the art. Naturally, the assumption may be made that the sample was taken at a further distance and the present invention is not limited solely to the 1 meter assumption, as discussed above.

At step 198, the processor 32 determines an "excess attenuation" variable. The excess attenuation variable includes all attenuation factors aside from the spherical distance. The spherical distance may be assumed, estimated, or calculated from known environmental characteristics.

The method 192 then proceeds to step 200 where the processor 32 determines a critical ratio ("CR") for the receiver R animal at the best target frequency. At step 202, the processor calculates, for a range of overall background noise levels, the spectrum level of the background. At this step, the processor 32 also may calculate a masked threshold, which is the sum in decibels of the spectrum level and the best CR. At step 204, the processor 32 calculates the limits of the attenuation of the signal so that it does not fall below the masked threshold. This value can be used to calculate the maximum distance between the sender S and the recipient R that is permitted so that the recipient R can detect the signal. The method 192 then proceeds to step 206.

At step 206, the calculation is repeated for target sound discrimination, which is selected as 2 dB less than the attenuation. For sound recognition, the calculation assumes that this is 4 dB less than the attenuation. For comfortable communication, the calculation assumes that the level is 15 dB less than the attenuation. As should be apparent, these are mere exemplary of one embodiment of the present invention. Other assumptions may be made without departing from the scope of the present invention.

From step 206, the method 192 proceeds to step 208 where the attenuation curves for the four levels of communication are plotted. Specifically, the plots indicate the noise level as a function of distance. Finally, at step 210, the schematic regions surrounding the receiver R are plotted. The schematic regions are representative of the four levels of communication, which are illustrated in FIG. 3.

Figure 14:
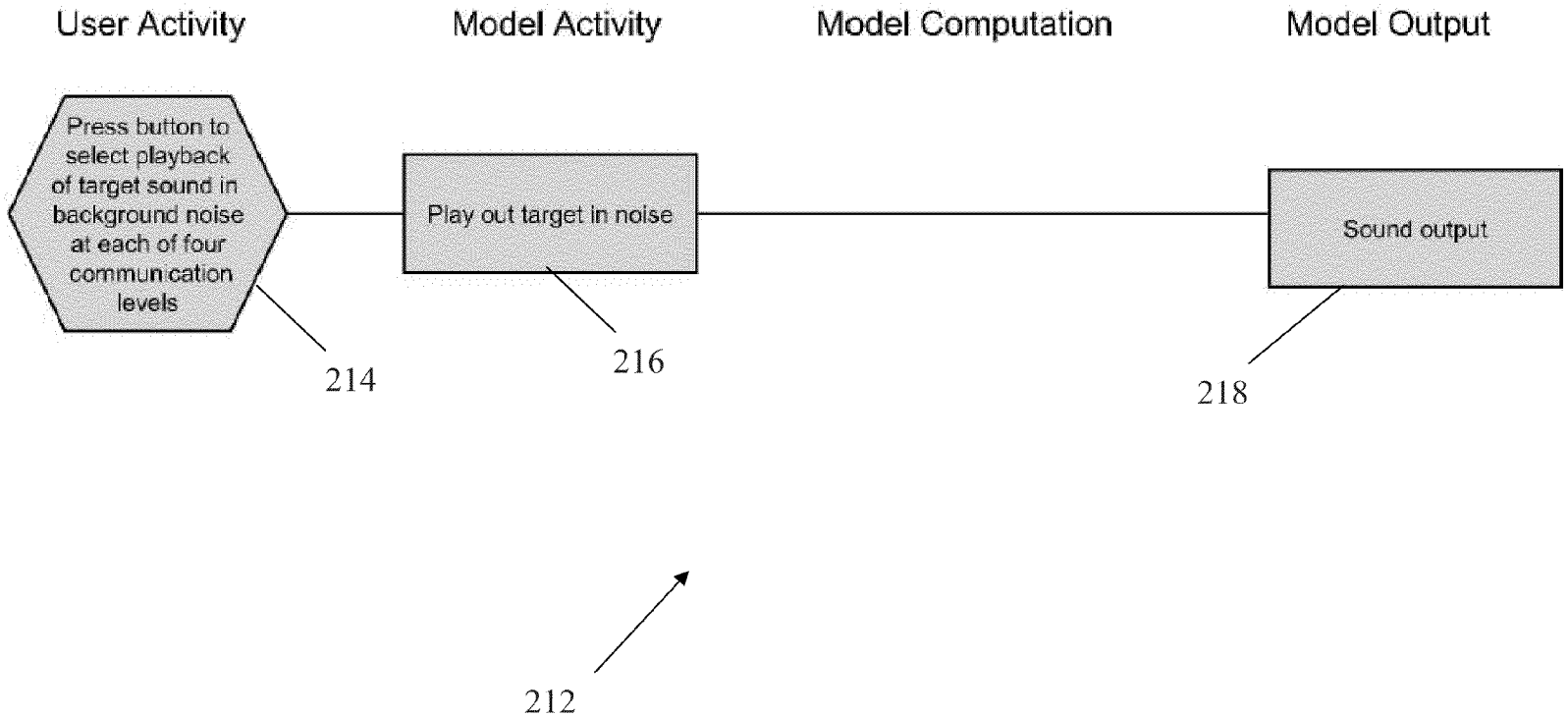
FIG. 14 is a flow diagram embodying a sixth contemplated instruction set that may be incorporated into the method of the present invention.

FIG. 14 illustrates a method 212. The method 212 is initiated at step 214 by a user selecting a playback of the target sound in the background noise for each of the four communication levels. At step 216, the target is played out in noise. At 218, a sound output is generated.

The present invention also contemplates determining how far away from a source of noise, for example a pile driver, a receiver bird will have to be before it can no longer hear the pile driver. In this contemplated embodiment, the ambient noise level at the receiver bird is measured and the level of noise at the source (i.e., the pile driver) replaces the sender. This embodiment contemplates calculating (or measuring directly) the level of the pile driving noise at the receiver, and then we using the receiver's auditory sensitivity (the critical ratio function) to determine at what distance from the sender (the pile driver) the sound is no longer audible to the receiver bird.

In the discussion of the methods of the present invention, steps have been discussed in a particular order. It is noted that these steps do not need to be performed in the order(s) described. To the contrary, many of the steps may be performed in different orders or simultaneously, without departing from the scope of the present invention.

As may be appreciated from the foregoing and from the figures appended hereto, the present invention encompasses a wide variety of different embodiments, variations, and equivalents. It is not intended that the present invention be limited to any one of the enumerated embodiments. To the contrary, the different embodiments may be combined with one another to create variations on the methods described. Moreover, the present invention is intended to encompass the variations and equivalents of the embodiments described herein.

What is claimed is:

1. A method for modeling the effects of anthropogenic noise on an animal's perception of other sounds, comprising:

positioning an acoustic receiver in an environment;

receiving, via the acoustic receiver, a first acoustic input comprising at least a first magnitude and a first spectral composition, wherein the first acoustic input establishes a first baseline for sound waves existing in the environment;

generating a first acoustic input signal from the first acoustic input;

transmitting the first acoustic input signal to a signal processor;

receiving a second acoustic input signal by the signal processor, wherein the second acoustic input signal comprises at least a second magnitude and a second spectral composition and wherein the second acoustic input signal establishes a second baseline for sound wave generation by a sender;

receiving a third input signal by the signal processor, wherein the third input signal comprises at least a quantification of auditory sensitivity by a recipient;

comparing, via the signal processor, the first acoustic input signal, the second acoustic input signal, and the third input signal to produce a comparison signal; and based on the comparison signal, determine a probability of detection of the second acoustic signal by the recipient.

2. The method of claim 1, further comprising:

receiving, via the acoustic receiver, a second acoustic input comprising at least the second magnitude and the second spectral composition, wherein the second acoustic input establishes the second baseline for sound wave generation by the sender;

generating the second acoustic input signal based on the second acoustic input; and transmitting the second acoustic input signal to the signal processor.

3. The method of claim 2, further comprising:

determining a first location for the first acoustic input;

generating a first location signal;

transmitting the first location signal to the signal processor;

determining a second location for the second acoustic input generated by the sender;

generating a second location signal;

transmitting the second location signal to the signal processor;

receiving by the signal processor a third location signal representative of the recipient at a third location;

calculating, via the signal processor, a distance between the second location and the third location;

calculating an attenuation of the second acoustic input taking into account at least the first acoustic input and the distance;

generating an attenuation signal from the attenuation; and when comparing the first acoustic input signal, the second acoustic input signal, and the third input signal modeling the interaction of the first acoustic input signal and the second acoustic input signal with respect to the attenuation signal.

4. The method of claim 3, wherein the sender is positioned at the second location.

5. The method of claim 2, further comprising:

generating a first location signal representative of a predetermined first distance from the acoustic receiver to the first acoustic input;

transmitting the first location signal to the signal processor;

generating a second location signal representative of a predetermined second distance from the acoustic receiver to the second acoustic input;

transmitting the second location signal to the signal processor;

receiving by the signal processor a third location signal representative of the recipient at a third location;

calculating, via the signal processor, a distance between the second location and the third location;

calculating an attenuation of the second acoustic input taking into account at least the first acoustic input and the distance;

generating an attenuation signal from the attenuation; and when comparing the first acoustic input signal, the second acoustic input signal, and the third input signal modeling the interaction of the first acoustic input signal and the second acoustic input signal with respect to the attenuation signal.

6. The method of claim 5, wherein the predetermined first distance from the acoustic receiver to the first acoustic input is at least 1 meter; and wherein the predetermined second distance from the acoustic receiver to the second acoustic input is at least 1 meter.

7. The method of claim 1, wherein the first baseline for sound waves in the environment comprises noise existing in the environment.

8. The method of claim 1, wherein the second baseline for sound wave generation by the sender comprises a vocalization by the sender.

9. The method of claim 1, wherein the sender and the recipient comprise at least one species from the animal genus.

10. The method of claim 9, wherein the at least one species comprises birds.

11. The method of claim 9, wherein the sender and the recipient comprise different species from the animal genus.

12. The method of claim 7, wherein the first acoustic input further comprises ambient environmental sound in addition to noise.

13. The method of claim 2, wherein, when comparing the first acoustic input signal, the second acoustic input signal, and the third input signal, the first acoustic input signal and the second acoustic input signal are compared with the third input signal to determine if one or both of the first acoustic input and the second acoustic input exceed a threshold for auditory detection by the recipient.

14. The method of claim 1, wherein the environment is a non-marine environment.

15. The method of claim 1, wherein the environment is a marine environment.

* * * * *